United States Patent [19]

Stefanini

[11] Patent Number: 4,570,935

[45] Date of Patent: Feb. 18, 1986

[54] MULTIPLE MAZE GAME

[76] Inventor: Giancarlo Stefanini, 90 Yorkleigh Ave., Weston, Ontario, Canada, M9P 1Y7

[21] Appl. No.: 545,282

[22] Filed: Oct. 25, 1983

[51] Int. Cl.[3] ..... A63F 9/06

[52] U.S. Cl. ..... 273/153 R; 273/1 GB

[58] Field of Search ..... 273/153 R, 155, 113, 273/1 GB

[56] References Cited

U.S. PATENT DOCUMENTS

| | | | |
|---|---|---|---|
| 417,931 | 12/1889 | Miatt | 273/153 R |
| 598,889 | 2/1898 | Young | 273/153 R |
| 600,696 | 3/1898 | Patterson | 273/153 R X |
| 2,011,266 | 8/1935 | Boynton | 273/153 R |
| 4,066,265 | 1/1978 | Bredlau | 273/153 R |
| 4,452,455 | 6/1984 | Bergstrom et al. | 273/155 |

FOREIGN PATENT DOCUMENTS

| | | | |
|---|---|---|---|
| 2027597 | 2/1980 | United Kingdom | 273/153 R |
| 637124 | 12/1978 | U.S.S.R. | 273/153 R |

*Primary Examiner*—Anton O. Oechsle

*Attorney, Agent, or Firm*—Rogers, Bereskin & Parr

[57] ABSTRACT

A game in the form of a maze is disclosed. The maze is formed by a series of concentrically arranged annular members defining a series of spaced gates through which a playing piece can be moved, and intervening blind compartments. The annular members can be turned relative to one another to vary the configuration of the maze. In a preferred embodiment, this is achieved by one of a set of different keys, each of which can be used to move the members through the required angular amounts to produce a different maze.

14 Claims, 10 Drawing Figures

MULTIPLE MAZE GAME

This invention relates generally to games and is concerned in particular with games of the type which include a maze and in which the object of the game is to move a playing piece through the maze.

Various games of this general form have previously been proposed. Perhaps the simplest comprises a plastic moulded tray in which the maze is formed, and a transparent cover which forms a lid for the tray and which is sealed thereto so as to enclose the playing piece. The playing piece itself is usually a ball bearing or other spherical object and the game is played by manipulating the tray to cause the ball bearing to roll through the maze.

As far as is known, the maze has always been of a fixed configuration in a game of this type, and an object of the present is to provide a game in which the configuration of the maze can be changed to provide for enhanced playing appeal.

In the game provided by the invention, the maze permits a playing piece to be moved between a central location and a plurality of outer locations and the maze is defined at least in part by a series of concentrically arranged annular members extending about an axis at said central location. The members are supported for turning movement with respect to one another about the said axis. Each member defines a plurality of gates spaced around the member and extending between the inner and outer circumference of the member, through which a playing piece can be moved. Intervening blind compartments are provided in each member. The gates in each member are arranged to co-operate with gates of adjacent members in each of a plurality of predetermined relative angular positions of the members to form a seires of respectively different paths through the maze. Thus, the configuration of the maze can be changed by turning the angular members to different positions about said axis.

The term "gate" is used in this application in the sense of an opening permitting a playing piece to move freely across the relevant annular member between its inner and outer circumference. The term "blind compartment" is intended to refer broadly to a space into and out of which a playing piece can be moved but which does not permit the playing piece to move across the relevant annular member.

The game may take various forms overall. In one form, the game could be designed to be manipulated in the manner of a conventional maze game, e.g. using a spherical playing piece which is caused to roll through the maze. Preferably, however, a transparent cover is provided over the annular members and the playing piece is manipulated through the maze by a magnet which is drawn across the upper surface of the transparent cover, while the playing piece itself is made of a metal which is capable of being attracted by a magnet. In this case, the game will remain stationary on a supporting surface while the playing piece is manipulated through the maze using the magnetic.

Whatever form the game may take overall, the playing appeal of the game is greatly enhanced as compared with a conventional fixed maze in that the annular members can be selectively turned to change the configuration of the maze and provide a different game. In the simplest form of game, the annular members could be arranged so that they can be turned individually by hand. In that case, the members would be appropriately marked, for example, using colour-coded markings arranged so that when appropriate markings were brought into alignment, a particular maze configuration would be provided while, when different markings were aligned, the maze would be different. Preferably, however, this is achieved automatically using actuator means in the form of a set of keys having actuator formations for co-operation with corresponding formations on the undersides of the annular members. In that case, the game would include means for supporting a selected one of the keys in a generally radial position below the annular members for movement angularly about the axis of the game through a predetermined increment. The actuator formations would then automatically move appropriate ones of the annular members through appropriate angular amounts to change the maze configuration.

In order that the invention may be more clearly understood, reference will now be made to the accompanying drawings which illustrate a preferred embodiment of the invention by way of example, and in which.

Figure 1:
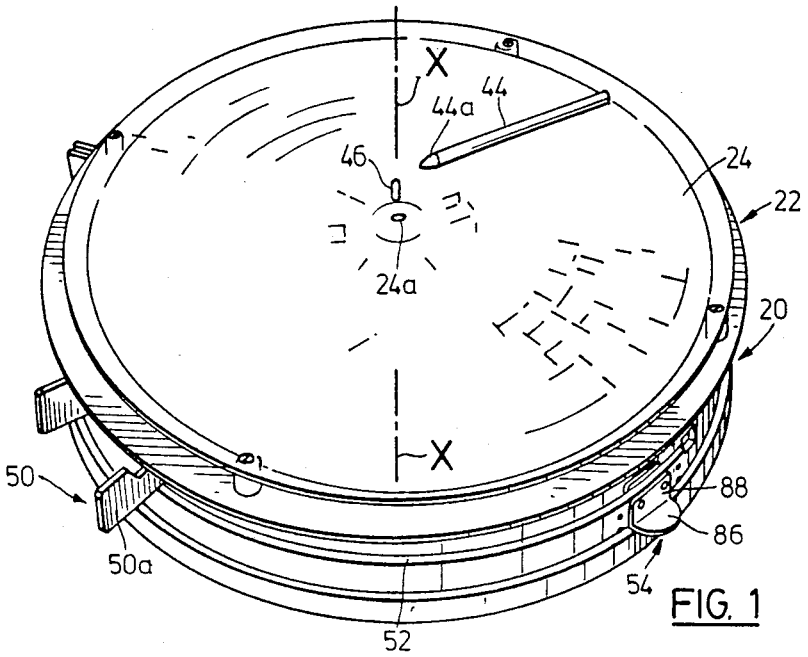
FIG. 1 is a perspective view from above of a prototype form of maze game in accordance with a preferred embodiment of the invention.

Referring first to FIG. 1, the game includes a circular base 20 and an upper part 22 which is supported on the base and which includes the maze itself. As seen in FIG. 1, the maze is largely obscured by a transparent plastic cover 24, while in FIGS. 2 and 3, the cover has been partly broken away to show the maze itself in two respectively different configurations.

Figure 8:
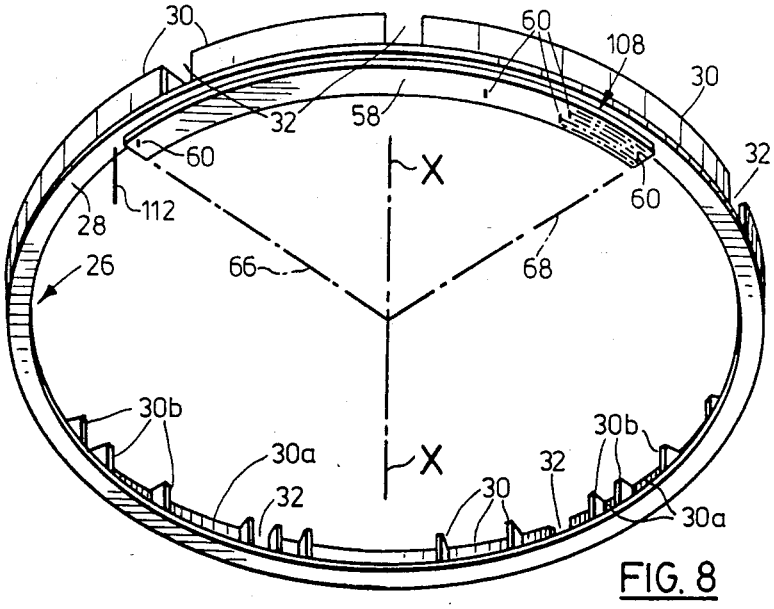
FIG. 8 is a perspective view from below of one of the annular members of the maze.

The maze is formed by a series of concentrically arranged annular members one of which is shown in perspective in FIG. 8 and is denoted by reference numeral 26. It will be seen from that view that each member includes an annular base 28 and a series of walls 30 which project outwardly from the top surface of base 28. These walls define a plurality of gates 32 spaced around the member, and intervening blind compartments 34. The gates extend between the inner and outer circumference of the annular member and are in effect formed by gaps in the walls 30. The blind compartments 34 are formed by arcuate wall portions **30*a* extending around the outer circumference of the member, and radial wall portions 30*b* which extend inwardly from the wall portions 30*a*** to define the compartments.

The game includes a series of annular members 26 similar to the member shown in FIG. 8 but with differently arranged walls 30. The members are of progressively smaller diameter starting with the outermost member and are arranged one within the other in a concentric configuration about the central location 36

Figure 2:
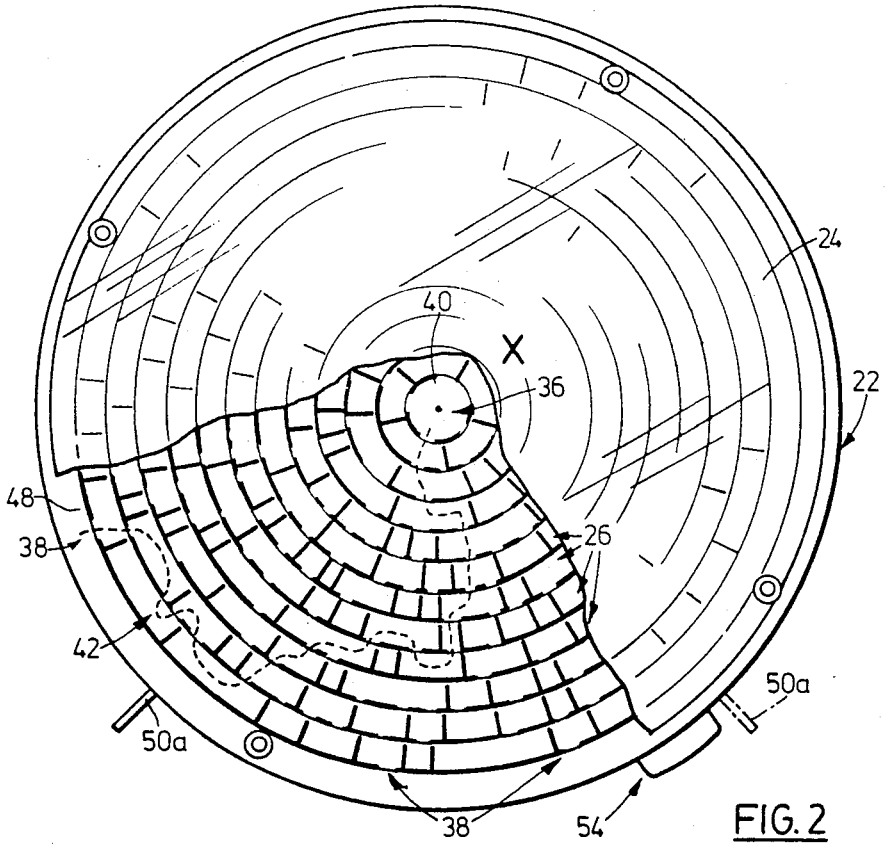
FIG. 2 is a plan view corresponding to FIG. 1, partly broken away to show a first maze configuration.
Figure 3:
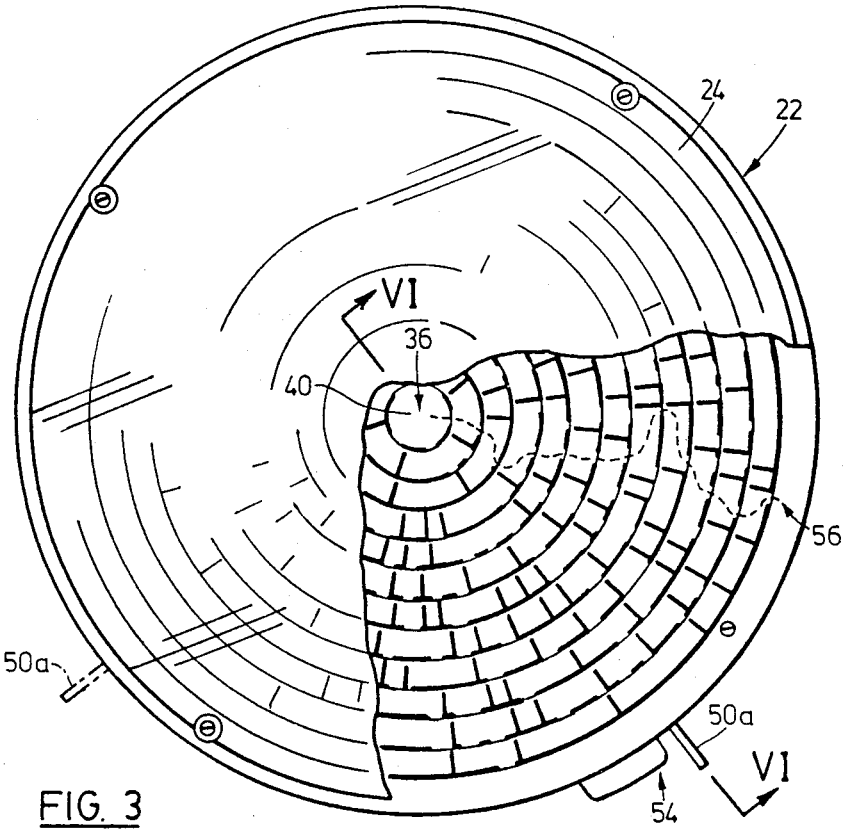
FIG. 3 is a view similar to FIG. 2 showing a second maze configuration.

(FIGS. 2 and 3). In this particular embodiment, there are eleven annular members arranged about a stationary circular member 40 at the central loction although there is of course no limitation to this particular number of annular members.

FIG. 2 shows the annular members assembled in their concentric arrangement and in predetermined rest or starting positions. It will be seen that the walls 30 of the respective members co-operate to define a first path 42 through the maze from the central location 36 to one of a series of outer locations 38. In order to avoid confusing the drawings, the abutting edges between the individual annular members 26 have not been shown but several of the annular members are individually denoted by reference numeral 26.

In this particular embodiment, the game is designed to be played using a wand 44 (FIG. 1) having a magnetic tip 44*a* and a "bullet" shaped playing piece 46 of a metal which is attracted to the tip 44*a*. The transparent cover 24 over the maze has a central opening 24*a* which is just large enough to permit the playing piece 46 to be inserted into the maze through the opening. The playing piece is then manipulated through the maze using the wand 44 by drawing the tip 44*a* of the wand over cover 24 in the path to be followed by the playing piece. When one of the outer locations 38 is reached, the playing piece exits the maze through a corresponding opening (one of which is denoted 48 in FIG. 2) and can be removed through the gap between the cover 24 and the base 22.

The annular members 26 are supported on base 22 (as will be described) so that the members are individually turnable about an axis X—X at the central location 36. The gates and blind compartments in the respective annular members are arranged so that, by turning the respective members through predetermined angular amounts, the members can be brought to locations in which a different path is defined through the maze. In this particular embodiment, the game is designed so that the annular members can be turned automatically through the required angular amount by any of a set of keys provided as part of the game. A typical such key is shown at 50 in FIG. 4. The description which follows will explain the manner in which the keys co-operate with the annular members to provide for the required movement. However, for purposes of illustration, it may be helpful to first compare FIGS. 2 and 3 which illustrate examples of two different maze configurations which can be achieved using one of the keys 50. The game is designed (as will be described) so that a selected key can be supported below the annular members in a vertical plane extending radially of axis X—X, and can be moved through a predetermined angular increment (in this case 90°) about axis X—X from a starting position to an advanced position. In FIG. 2, part of the head of one of the keys 50 is shown at 50*a* projecting from the base 22. The head of the same key is also visible in perspective in FIG. 1 and it will be seen that an arcuate slot 52 is provided in the wall of base 22 to permit the required angular movement of key 50 from the starting position in which it is shown at the left-hand end of the slot 52 in FIG. 1, to an advanced position at the right-hand end of that slot. A latch mechanism 54 is provided to retain the key in the advanced position and will be described later primarily with reference to FIGS. 4 and 7.

In FIG. 2, the key head 50*a* is shown in full lines in the starting position and in ghost outline at 50*a* in the advanced position. Conversely, FIG. 3 shows the head of the key in full lines in the advanced position and in ghost outline in the starting position. In FIG. 3, the annular members have turned through the required angular amounts to provide a different maze configuration defining a new path 56 from the central location to one of the outer locations. Not all of the annular members move through the same angular amount (90°) as the key 50. This is achieved by the use of strategically placed actuator pins which project downwardly from the respective annular members for cooperation with the key 50 as will now be described.

Referring first to FIG. 8, it will be seen that each of the annular members 26 is provided at its underside with an arcuate shaped retaining shoe 58. The length of the shoe corresponds to 90° of arc at axis X—X. Projecting downwardly from shoe 58 is a series of actuator pins 60. In this case, there are five pins and they are arranged at different positions along the length of the shoe. In addition, the pins are spaced across the width of the shoe; that is, in the radial direction with respect to axis X—X. In this particular embodiment, each pin is disposed on one of five notional "tracks" at different radial distances from axis X—X as represented by the chain-dotted lines generally denoted 62 in FIG. 8. Referring back to FIG. 4 it will be seen that the key 50 has a series of formations 64 projecting from its top edge. These projections are designed to co-operate with the pins 60 as the key is moved from its starting position to its advanced position along slot 52 (FIG. 1) in the assembled game. It will be appreciated that, by appropriately positioning the pins 60 in the radial direction with respect to axis X—X and by correspondingly designing the formations 64 of the key, the key will engage (or not engage) selected ones of the pins as the key moves from its starting position to its advanced position. When a formation 64 engages a particular pin, the annular member from which that pin depends will be "picked up" by the key and move with the key until the key reaches its advanced position. The position of the pin along the length of the relevant retaining shoe 58 will determine the angular amount by which the annular member is turned. For example, in FIG. 8, if the two radial chain-dotted lines 66 and 68 represent respectively the starting position and the advanced position of the key, if one of the key formations 64 engages the first pin 60 shown at the left-hand end of the retaining shoe 58, then that particular annular member will move through a full 90°. On the other hand, if the key is configured to miss that pin and pick up the next pin, then the annular member will move through a much smaller angular increment. As indicated previously, a set of keys as key 50 will be provided. Different keys will have differently configured formations 64 to cause respectively different amounts of angular movement of the annular members and produce different maze configurations.

By way of example only, the following is an illustration of the different angular amounts through which different angular members might move for one particular key. The numbers in the left-hand column below denote the different angular members starting with member No. 1 as the outermost member and the figures in the adjacent column indicate the angular amount through which that particular member moves for a full 90° movement of the particular key:

| Member No. | Angular Movement |
|---|---|
| 1 | 90° |
| 2 | 59° |
| 3 | 90° |
| 4 | 10° |
| 5 | 16° |
| 6 | 7° |
| 7 | 7° |
| 8 | 15° |
| 9 | 90° |
| 10 | 80° |
| 11 | 31° |

Figure 4:
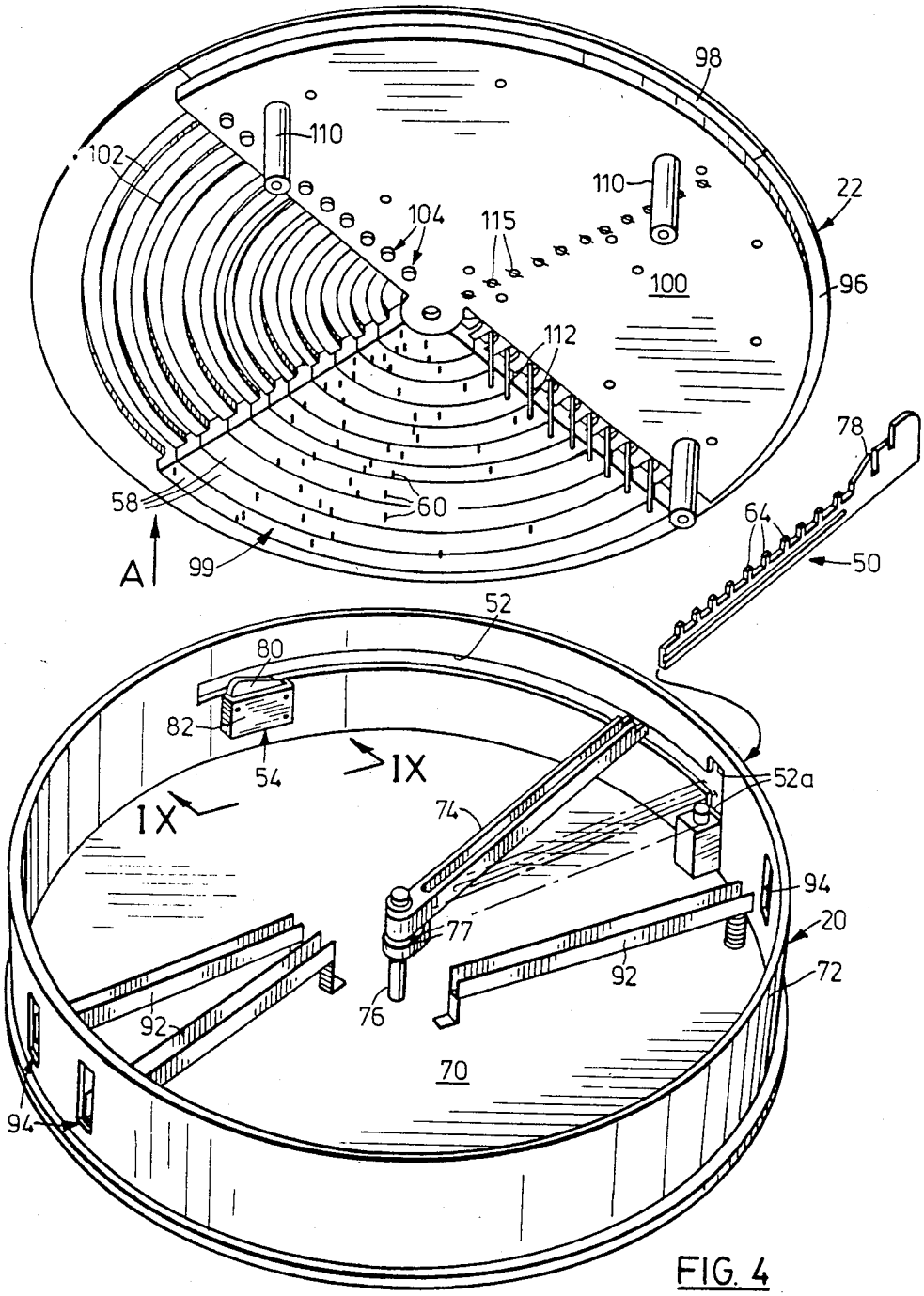
FIG. 4 is an exploded perspective view of the game.

FIG. 4 illustrates the manner in which the keys are supported during their arcuate movement below the annular members. In that view, the upper part 22 of the game including the annular members have been shown exploded above the base 20 (and will be described later). It will be seen that base 20 includes a base plate 70 from which an annular wall 72 projects upwardly and serves to support the upper part of the game. The slot 52 (FIG. 1) along which the key moves is provided in this wall and is seen from the inside in FIG. 4. The main part of slot 52 is parallel sided but is enlarged at its end 52*a* corresponding to the starting position for the key. The enlargement 52*a* allows the key 50 to be inserted radially through the slot and into a supporting channel 74 which extends radially outwardly from a post 76 on the channel axis X—X of the game. Channel 74 is turnable on post 76 to move with the key in travelling from its starting position to its advanced position and is fitted with a return spring 77. The walls of the channel are cut away at its outer end so that the channel can rest on the lower wall of slot 52 for supporting the key. The key itself has a vertical slot 78 at a position spaced in from its outer end in which the portion of wall 72 immediately above slot 52 engages to properly radially orient the key with respect to the actuator pins 60 on the annular members. In other words, the key is inserted to a depth such that slot 78 aligns with the edge, denoted 72*a*, of the portion of wall 72 above slot 52. Only then can the key be moved along the slot.

Figure 9:
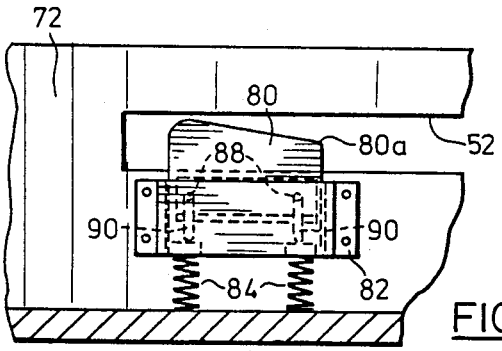
FIG. 9 is an elevational view in the direction of the arrows denoted IX—IX of FIG. 4; and, FIG. 10 is a diagrammatic plan view of the maze.

As key 50 approaches the advanced position it encounters the latch mechanism 54. With particular reference to FIG. 9, it will be seen that the latch mechanism includes a latch member 80 having an inclined upper surface 80*a* up which the key will ride as it approaches the advanced position. Member 80 is vertically slidable in a housing 82 secured to the inner surface of wall 72 (FIG. 4). A pair of compression springs 84 bias the latch member upwardly into the position in which it is shown in FIG. 9. Thus, key 50 will ride up surface 80*a* and depress the latch member against its spring biassing. However, once the key reaches the advanced position, the latch member will move up under the action of the springs 84 and will prevent return movement of the key.

When the key is to be released, the latch member 80 can be depressed by a release lever 86 at the outer side of wall 72 as best seen in FIG. 1. Lever 86 is generally L-shaped and defines a horizontal limb by which the lever is operated, and a vertical limb adjacent side wall 72. Two pins 88 project through vertically elongate slots 90 in wall 72 (see FIG. 9) and are coupled to latch member 80 at the inner side of the wall. Thus, by pressing down on lever 86, the latch member 80 is depressed against the springs 84.

As indicated previously, it it intended that a set of keys will be supplied with the game. Unused keys will be stored within base 22 in storage channels 92 as shown in FIG. 4. It will be seen that the channels align with openings 94 in wall 72 and that each channel is spring biassed upwardly at the end adjacent wall 72 so that a stored key will be biassed upwardly at its outer (head) end. This allows a key to be positioned so that its slot 78 (as in key 50) will embrace the part of wall 72 above opening 94 for retaining the key. The channels 92 are flexibly mounted at their opposite ends to allow some degree of vertical movement at the outer end of the channel. It should also be noted that the channels 92 are not radially oriented so as to avoid interfering with post 76 or the key support channel 74.

Figure 7:
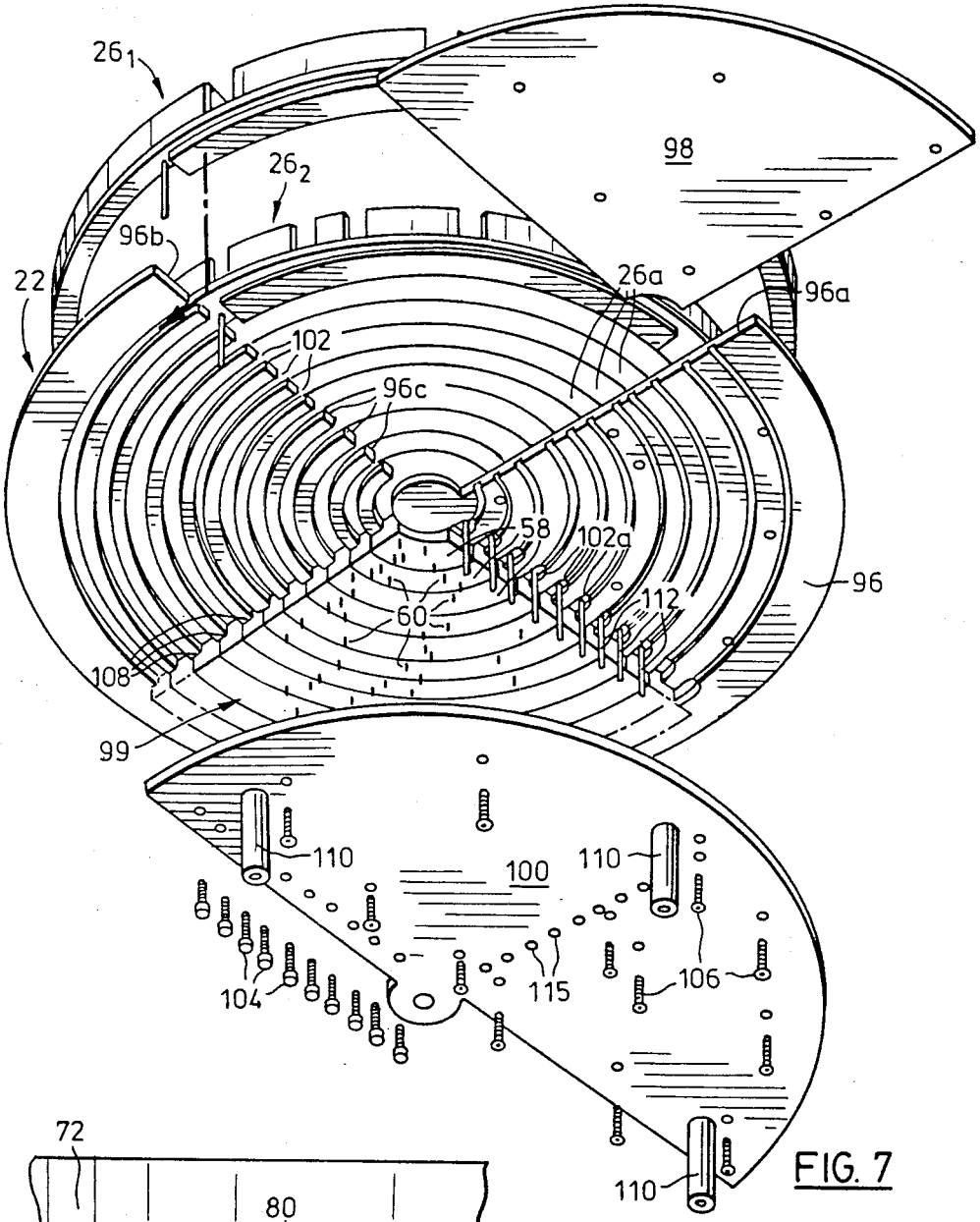
FIG. 7 is an exploded perspective view of the upper part of FIG. 4.

As noted previously, the base 20 also serves to support the upper part 22 of the game which is shown an exploded position above the base in FIG. 4. In FIG. 7, that part of the game is shown further exploded. This part includes the annular members 26 and the components which support those members while permitting the required angular movement thereof about axis X—X. This part of the game will now be described.

Referring primarily to FIG. 7, a main support plate 96 is provided for the annular members. This plate has the general overall shape of three quarters of a circle (270° of arc) and has radial end edges 96*a* and 96*b* at right angles to one another. The "missing" segment of the circle is completed by a separate plate 98 which describes the remaining 90° and which is shown partly exploded away from the main plate 96 in FIG. 7. In the assembled game, plate 98 co-operates with plate 96 to form a full circular shape but the plate 98 is removable to permit assembly of the game as will be described later. A separate cover plate 100 which is shown exploded below plate 96 is bolted the two plates 96 and 98 from below in the assembled game. The three plates are shown bolted together in FIG. 4.

The main plate 96 is formed with a series of arcuate slots 102, one for each of the annular members 26 and the slots extend from plate edge 96*b* over 180° of arc, terminating in rounded ends denoted 102*a* in FIG. 7. The "lands" between these grooves are denoted 96*c* and terminate in free ends, each of which is bolted to the cover plate 100 by one of a series of bolts 104 shown exploded below the cover plate in FIG. 7. Other bolts for securing the cover plate to the main plate 96 and the plate 98 are generally denoted 106. Thus, in the assembled game, the cover plate serves not only to hold together the plates 96 and 98 but also to secure the free ends of the lands 96*c* between the grooves 102.

The plates 96 and 98, when assembled, serve to support the angular members and the lower surfaces of several of those members are visible in FIG. 7 in the space normally occupied by plate 98. Those surfaces are denoted 26*a*. Referring back to FIG. 8, it will be remembered that each member has an arcuate shaped retaining shoe 58 at its underside. These shoes extend over 90° of arc about axis X—X. In FIG. 7, the retaining shoes of almost all of the annular members 26 are shown at 99 assembled together below plate 96, occupying a 90° segment of arc. The shoes are undercut along their outer edges as indicated at 108 in FIG. 8 and in FIG. 7 to accommodate the lands 96*c*. Stated differently, the portions of the shoes adjacent the undercut areas 108 are received in the grooves 102 in plate 96. This arrangement allows the annular members to turn on plate 96 while retaining the members in contact with the plate.

The fact that the plate 98 is separate from plate 96 (in a sense is a removable segment of the plate) permits installation of the annular members on plate 96. Thus, with plate 98 removed, each annular member is in turn placed on the top surface of the plate with its retaining shoe 58 in the gap which will later be occupied by plate 98. In FIG. 7, the outermost annular member, denoted $26_1$ is shown in this position but exploded above plate 96 while the next adjacent member $26_2$ is shown resting on the plate with its shoe 58 in the "gap" which will later be occupied by plate 98. If that member is then turned counterclockwise as drawn (in the direction of the arrow) the retaining shoe 58 will pass into the relevant slot 102 and continued turning of the annular member will bring the shoe into proper relationship with the shoes 58 of the other members which have previously been installed. The outer member $26_1$ can then be lowered and inserted into the outer groove 102 in similar fashion. Plate 98 is then installed and cover plate 100 is bolted into place to complete the assembly. Of course, once the game has been assembled, it will not normally be necessary to remove cover plate 100 or plate 98, except for purposes of repair.

FIG. 4 shows the assembly of the top part of the game at this time. It will be noted that the plates 96 and 98 project slightly beyond cover plate 100 to form a lip which rests on the upper edge of the base side wall 72. Three posts 110 extend downwardly from cover plate 100 and have screw-threaded openings at their lower ends for receiving retaining screws (not shown) inserted upwardly through appropriately positioned openings (not shown) in the bottom wall 70 of base 20.

FIG. 4 also shows stop pins 112 which project downwardly from each of the annular members 26 for defining the rest positions of the members. These pins are arranged to abut against the rounded ends 102*a* of the slots 102 when the annular members are in their starting positions. The pins 112 project to a substantial extent below the actuator pins 60 on the retaining shoes so that they will all be contacted by the side surface of any one of the keys 50 when the key is returned from its advanced position to its starting position at the conclusion of a game. Thus, the key will have the effect of "sweeping" all of the annular members back to the rest position as the key is returned to its rest position. Each annular members is also provided with a return spring, one of which is indicated at 114 in FIG. 5. The spring extends from pin 112 along the associated slot 102 and into an aligned groove (not shown) in the top of plate 96 to one of a set of spring retaining openings 115 (one for each annular member) in plates 96 and 100. The intention is that the return springs will automatically move each annular member back to its starting position when the key is released, but contact between the key and the pins 112 will assure that the annular members are positively returned and will guard against the possibility of jamming of one or more of the annular members. It will of course be appreciated from this that, when the key 50 is in its starting position, it will lie with its relevant side surface (the surface which leads when the key is returned) lightly in contact with the pins 112 with the pins in positions shown in FIG. 4. Thus, the starting position of the key will also correspond to the starting positions of the annular members.

Figure 5:
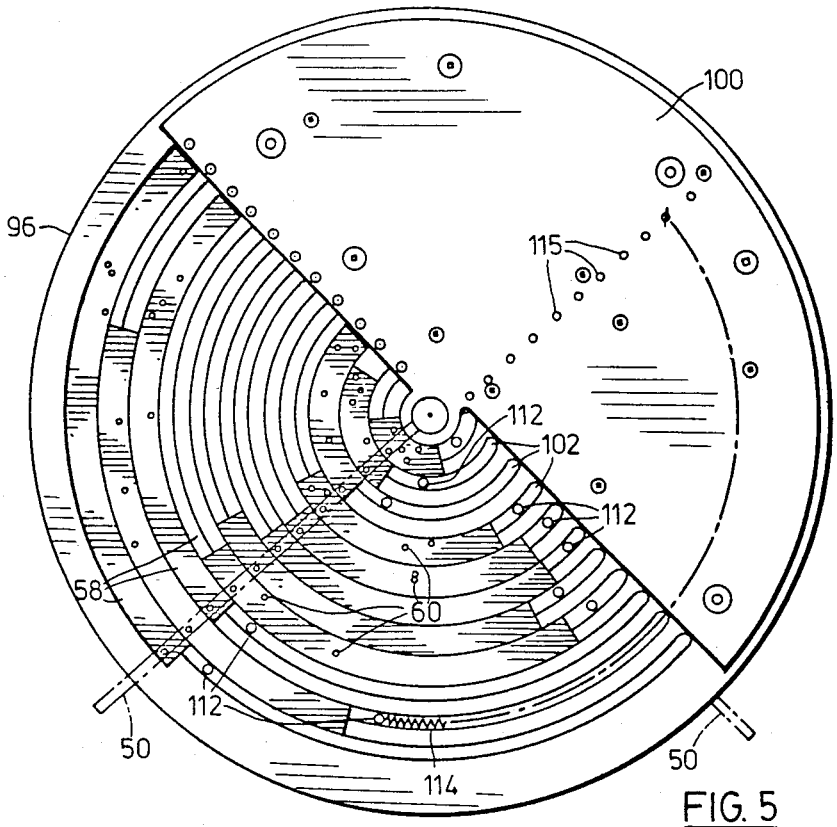
FIG. 5 is an underneath plan view in the direction of arrow A in FIG. 4.

By way of further illustration, FIG. 5 is an underneath plan view of the top part 20 of the game showing the key 50 moved to its advanced position as indicated in ghost outline. It will be seen that the formations 64 on the key have "picked up" appropriate ones of the actuator pins 60 on the annular members and moved those members through angular amounts depending on the positions of the selected pins. The solid arcuate areas which have been emphasized in FIG. 5 represent the retaining shoes of the annular members and quite graphically illustrate the different angular amounts through which different members have moved. FIG. 5 also shows the stop pins 112 (shown substantially larger than the actuator pins 60) and illustrates the fact that they are all disposed at the trailing side of the key (as moving from its rest position to its advanced position) so that they will be swept back to the ends of the slots 102 when the key is returned.

Figure 6:
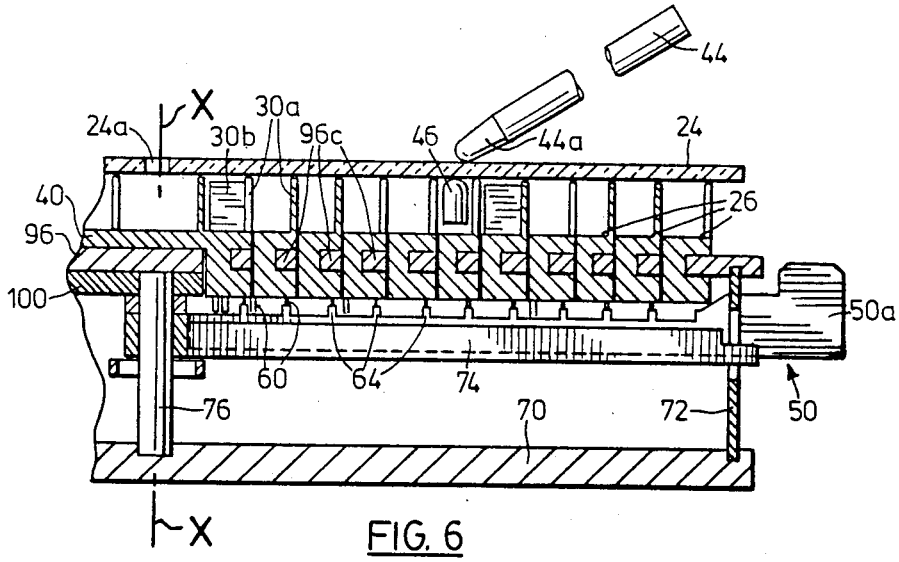
FIG. 6 is a sectional view on line VI—VI of FIG. 3.

FIG. 6 shows the key 50 in a position such as it might occupy in the position of FIG. 5 with its formations 64 engaging some (but not all) of the actuator pins 60 on the annular members. The key is shown retained in its advanced position while a game is being played using the wand 44 and playing piece 46.

Figure 10:
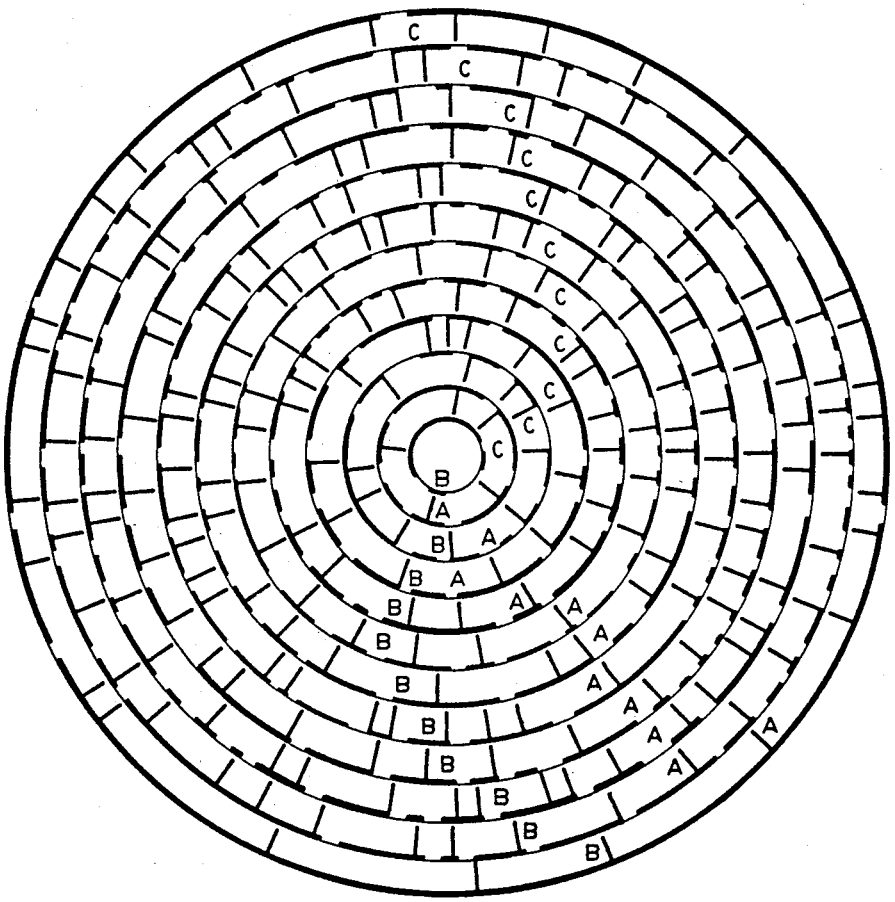

Finally, FIG. 10 is a diagrammatic plan view showing the arrangement of gates and compartments on the annular members 26. Of course, this represents one example only. The members are shown in their starting positions and have been marked A, B and C. By rotating the annular members to align all of the "A", "B" or "C" markings, three different maze configurations can be produced.

It will of course be understood that the preceding description relates to a particular preferred embodiment of the invention and that many modifications are possible within the broad scope of the invention. For example, and as indicated previously, the annular members could be moved individually by hand to preselected positions indicated, for example, by colour-coded or other markings, rather than being moved mechanically by a key as in the preferred embodiment. Other mechanical devices may of course be used in place of a key. Of course, the annular members need not be moved through a maximum angle of 90° as disclosed or in the direction shown.

The placing piece need not be moved through the maze by a magnetic wand as described. For example, in a simpler version of the game, a lightweight plastic handheld unit could be provided in which the annular members would be individually moved manually and the playing piece would be manipulated through the maze by tilting the game. The maze need not be formed solely by movable annular members; those members could form part of a larger maze. Also, the compartments and gates could be formed otherwise than as shown, for example, by grooves or recesses in the top surfaces of the annular members. The annular members need not provide a path through the maze when in their starting positions.

It should also be noted that the drawings illustrate a protype form of the game, and that while the drawings are believed to disclose sufficient detail to permit a person skilled in the art to construct a similar protype, many of these constructional details will probably change in the actual practice. For example, it is envisaged that the game will probably be constructed solely or primarily of plastic components which means that plastic moulding and constructional techniques will be employed.

I claim:

1. A game including a maze through which playing pieces can be moved between a central location and a plurality of outer locations, wherein the maze is defined at least in part by a series of concentrically arranged annular members extending about an axis at said central location, and wherein means is provided supporting said members for turning movement with respect to one another about said axis from predetermined respective starting positions, each said member defining a plurality of gates through which a playing piece can be moved, and intervening blind compartments, the gates being spaced around the member and extending between inner and outer circumferences thereof, and the gates being arranged to co-operate with similar gates of adjacent members in each of a plurality of predetermined relative angular positions of the members to form a series of respectively different paths through the maze, whereby the configuration of the maze can be changed by turning the annular members to different angular positions about said axis, and wherein the game further includes means for simultaneously moving at least some of said members from their starting positions each through a predetermined angular amount to a position in which the members together define a path through the maze, said means comprising a key, and means adapted to support the key in a generally radial position below said annular members for movement through a predetermined angular amount from a starting position to an advanced position, wherein the key and annular members are provided with co-operating formations arranged to cause the required respective angular movements of relevant ones of said members through said predetermined angular amount in response to said movement of the key.

2. A game as claimed in claim 1, wherein said members define a path through the maze in their starting positions.

3. A game as claimed in claim 1, wherein said co-operating formations comprise upwardly extending projections on the key and depending pins on the annular members.

4. A game as claimed in claim 1, comprising a set of said keys defining respectively different formations for co-operation with the annular members, and wherein the formations are adapted to permit each key to move the members through angular amounts selected to define respectively different paths through the maze.

5. A game as claimed in claim 4, wherein said base is provided with storage compartments for receiving unused ones of said keys.

6. A game as claimed in claim 1, wherein said means supporting the annular members for turning include a base having a side wall formed with a slot along which said key can be moved from its said starting position to its said advanced position, and wherein the game further includes a key supporting member adapted to receive a key inserted into said slot and to support the key during its movement between its said starting position and its said angular position.

7. A game as claimed in claim 1, wherein said predetermined angular amount through which the key can be moved from its rest position to its advanced position corresponds to 90° of arc about said axis and wherein the maximum angular amount through which any one of said angular members can move is 90°.

8. A game as claimed in claim 1, further comprising releasable latch means adapted to retain a said key in its advanced position.

9. A game as claimed in claim 8, further comprising means associated with each said annular member and arranged to bias the member towards its said rest position.

10. A game as claimed in claim 1, wherein each said annular member is provided with stop means defining said starting position of the member, said stop means including a stop pin depending from the member, and wherein the key is arranged to engage said stop pins and return the annular members to their starting positions when the key is returned from said advanced positioned to said rest position.

11. A game as claimed in claim 1, wherein said means supporting the annular members for turning comprise a base having a generally cylindrical side wall and a top plate supported on said wall and carrying the annular members.

12. A game as claimed in claim 11, wherein said plate is provided with a series of arcuate grooves, one corresponding to each said annular member, and wherein each member is provided with an arcuate retaining shoe which extends through the groove for guiding the annular member in its turning movement.

13. A game as claimed in claim 12, wherein each said annular member has a top surface provided with upstanding walls defining said gates and compartments.

14. A game as claimed in claim 1, further comprising a transparent cover extending over said annular members while permitting turning of the members, a wand having a magnetic tip and a playing piece of a metal which is attractable to said tip, whereby the playing piece can be manipulated through the maze by drawings the tip of the wand across said transparent cover.

* * * * *